US006045052A

United States Patent [19]

Besenschek

[11] Patent Number: 6,045,052

[45] Date of Patent: Apr. 4, 2000

[54] RAIL TIE FASTENING ASSEMBLY

[75] Inventor: Viktor Besenschek, Kitchener, Canada

[73] Assignee: AirBoss of America Corp., Canada

[21] Appl. No.: 09/054,135

[22] Filed: Apr. 2, 1998

[51] Int. Cl.[7] ..... E01B 19/00

[52] U.S. Cl. ..... 238/382; 238/264; 238/283

[58] Field of Search ..... 238/2, 264, 283, 238/349, 351, 382

[56] References Cited

U.S. PATENT DOCUMENTS

| | | | |
|---|---|---|---|
| 31,283 | 1/1861 | Weight . | |
| 590,108 | 9/1897 | Lewis . | |
| 801,278 | 10/1905 | Terwilleger . | |
| 961,052 | 6/1910 | Warren . | |
| 1,039,748 | 10/1912 | Hyle et al. . | |
| 1,045,741 | 11/1912 | Pinney . | |
| 1,058,435 | 4/1913 | Hyle . | |
| 1,406,074 | 2/1922 | Pierson . | |
| 1,750,735 | 3/1930 | Tupper . | |
| 1,772,875 | 8/1930 | O'Brien . | |
| 2,057,955 | 10/1936 | Kahn . | |
| 2,337,497 | 12/1943 | Reddick | 238/283 |
| 2,609,991 | 9/1952 | Jones | 238/283 |
| 3,223,328 | 12/1965 | Moses et al. | 238/382 |
| 3,576,293 | 4/1971 | Landis | 238/283 |
| 3,784,097 | 1/1974 | Landis | 238/283 |
| 3,831,842 | 8/1974 | Tamura | 238/283 |
| 4,254,908 | 3/1981 | Matsubara | 238/283 |
| 5,549,245 | 8/1996 | Kish | 238/283 |
| 5,692,677 | 12/1997 | Duconseil | 238/283 |
| 5,735,457 | 4/1998 | Bohm et al. | 238/283 |

FOREIGN PATENT DOCUMENTS

| | | | |
|---|---|---|---|
| 1-315501 | 12/1989 | Japan | 238/382 |
| 2237833 | 5/1991 | United Kingdom | 238/382 |

*Primary Examiner*—Mark T. Le
*Attorney, Agent, or Firm*—Handal & Morofsky

[57] ABSTRACT

An easily installed rail tie mounting assembly has a railroad rail which is supported by an inventive rail seat disposed on and supported by a concrete rail support member. The inventive rail seat consists of a elastometric rail pad and a non-corrodible metal plate. The rail pad is configured with air channels which aid and the vibration absorbing properties of the pad, also the rail pad has positioning tabs to aid in the placement of the railroad rail. The metal plate has a polymer coating disposed on the bottom surfaces of said plate. The polymer coating facilitates installation and contributes to the abrasion resistant qualities of the rail tie mounting assembly.

24 Claims, 5 Drawing Sheets

RAIL TIE FASTENING ASSEMBLY

TECHNICAL FIELD

The present invention relates to an easily installed rail tie mounting assembly comprising an elastometric rail pad used in conjunction with a polyurethane coated metal abrasion plate, to provide an improved rail tie mounting assembly advantageous for use with a concrete rail tie.

BACKGROUND

In the past, much effort has been devoted to the development of railroad tie fastening assemblies. In the nearly two centuries since railroads began to shrink the vast expanses which separate us, rail systems have evolved from the crude forgings and substantially raw timber ties, which the limited range of technologies available at the time could produce, to more elaborate systems, including chemically treated wooden ties and, in more recent times, concrete railroad ties. The desirable qualities of railroad rail fastening assemblies include reliability, wear and abrasion resistance, cushioning ability, electrical insulation of the rail, ease of installation, and economy.

In recent years, the trend has been toward railways which have their rails set on concrete rather than the older wooden ties. Standing alone, however, these concrete ties lack some of the advantageous qualities of the traditional wooden ties which they are replacing, such as vibration dampening characteristics. In order to improve the characteristics of concrete rail tie rail support systems, fastening systems utilizing rubber pads have been developed. The rubber pads have been found to be useful in damping rail vibrations, and electrically insulating the rail from the concrete tie.

For example U.S. Pat. No. 3,581,990 Kirik, discloses a rail mounting assembly for use in connection with concrete railroad ties. In the assembly disclosed in this patent, a rubber tie pad having electrical insulating, sound deadening, and vibration dampening properties is positioned between the rail and the concrete tie. This allows the rubber tie pad to electrically insulate the rail from the concrete tie, reduce rail slippage, and dampen rail vibrations and noise.

While the addition of a rubber tie pad improved some of the drawbacks associated with concrete ties, at least one new problem was created. Traditionally, a locomotive is used to apply a silica sand to a rail for the purpose of improving traction in areas of the track where slippage of the wheels can occur. The most common place for the application of sand to the rail is on a curve or on an incline.

As may be apparent, the use of sand on a rail which is inclined prevents wheel slippage. The need to apply sand to curved sections of railroad track arises because, when a train encounters a curve, the momentum of the train attempts to force the train to continue moving in a straight line. Of course, the rail on the outside of the curve then forces the train to continue along the curve. The use of sand on the curved portion of a rail tends to keep the wheels of the train in engagement with both rails, thus maintaining control and protecting, to some extent, the outside rail from extraordinary stresses. However, the force applied by the train to the rails causes the rubber tie pads to move in relation to the concrete tie. When the sand and moisture seep between the rubber tie pad and the concrete tie, the back and forth movement of the rubber tie pad on the concrete tie causes erosion of the concrete and the rapid deterioration of the rubber tie pad. This results in even more serious slippage and generally increased movement of the rubber tie pad, as well as loss of electrical insulating properties, increased noise and vibration in the rail and a shorter life span for the concrete tie.

In order to improve the resistance of the concrete tie pad to erosion a metal abrasion plate was added to the fastening system. The abrasion plate was placed between the rubber tie pad and the concrete tie. The purpose of the abrasion plate was to protect the rubber tie pad and the concrete from the damaging effects of the sand. The object was to protect the top surface of the concrete railroad tie from any sand or grit which would otherwise be caught between the rubber tie pad and the concrete tie. The expected result would be the concentration of the abrasive effects of the sand on the metal abrasion plate, rather than the concrete tie. Since the plate was made from hardened steel or a similar material, it was expected that little wear would take place on the plate.

In U.S. Pat. No. 4,925,094 Buekett, a concrete railroad tie is disclosed which is characterized by a stainless steel plate cast into the top surface of the railroad tie, having lugs projecting from the plate thereby providing a mechanical connection with the concrete rail tie. A rail pad is then disposed between the plate and the rail. The methods of casting the concrete tie around the plate insures that the plastic plate and the concrete tie match in shape. U.S. Pat. No. 5,110,046 Young, discloses a variation of this idea. In Young, a thin metal plate is placed between a rail pad and concrete rail tie, and the thin metal plate is bonded to the concrete rail tie by use of an epoxy adhesive. However, use of adhesive is not an effective solution, because, in time, sand and moisture become lodged within a void created between the metal plate and the concrete tie, resulting in abrasion and then erosion of the concrete tie.

SUMMARY OF THE INVENTION

The above problems stem from the fact that railroad tie top surfaces are not uniform in shape. For example, it has been proposed that the epoxy layer of Young could be replaced by a foam pad. Presumably, this has been suggested because the foam pad will conform itself to any irregularity. However, such a system has never been commercialized, and is unlikely to be successful because the placement of a relatively fragile foam layer between two elements which move with tremendous compressive force will cause relatively rapid deterioration of the foam. The foam is totaly compressed and sqeezed out of high points on the concrete rail tie. Only a small foam lip around the plate is available to keep sand and water from entering under the plate. This is a very fragile which is prone to fracture of the joint.

The invention, as claimed, is intended to provide a remedy. It solves the problem of how to enjoy the advantages of concrete ties, while at the same time minimizing the problems and costs associated with maintenance of conventional concrete rail tie assemblies. By using the inventive rail tie assembly, whether in a new system, or in repairing existing concrete rail tie systems, concrete ties can be used while substantially avoiding or reducing many of the above problems.

The preferred embodiment of the present invention is used in conjunction with a concrete rail tie which has been cast in the conventional manner. The rail is disposed over a conventional polyurethane rail pad , which in turn sits on top of a specialized plate, preferably made of a high strength steel alloy in accordance with the present invention. The specialized plate, in turn, sits on top of the concrete railroad tie. The specialized steel plate comprises a high strength alloy steel which has been coated on at least its bottom with a relatively soft and rubber-like polyurethane plastic, selected for its high coefficient of friction. In accordance with the invention, the coating of polyurethane plastic on the bottom of the steel plate has a configuration which prevents rocking of the plate on the top surface of the concrete tie. More particularly, the coating of polyurethane plastic on the bottom of the plate is thinner in the central portion of the plate, resulting in a shallow depression in the polyurethane coating. This particular configuration eliminates both the need for adhesion and a perfectly fitting plate, while providing superior wear and performance characteristics. Because the plate is provided with an underside having a raised perimeter, this causes the specialized plate to sit without moving on top of a concrete railroad tie, whether the top surface of the concrete is convex, concave or flat.

The inventive rail tie assembly can be used on any type of track, but is particularly effective on tight curves and, in replacement of rail support assemblies in existing rail systems, concrete ties which have been abraded. When the inventive rail tie assembly is employed significant wear and abrasion can be avoided on the concrete tie. The soft polyurethane coating on the metal plate has a very high coefficient of friction and it thus keeps the plate in place. Because no movement of the plate with respect to the concrete tie takes place, sand and other abrasive materials cannot migrate between the top face of the concrete railroad tie and the bottom of the plate.

BRIEF DESCRIPTION OF THE DRAWINGS

One way of carrying out the invention is described in detail below with reference to drawings which illustrate only one specific embodiment of the invention and in which.

DETAILED DESCRIPTION OF THE PREFERRED EMBODIMENTS

Figure 1:
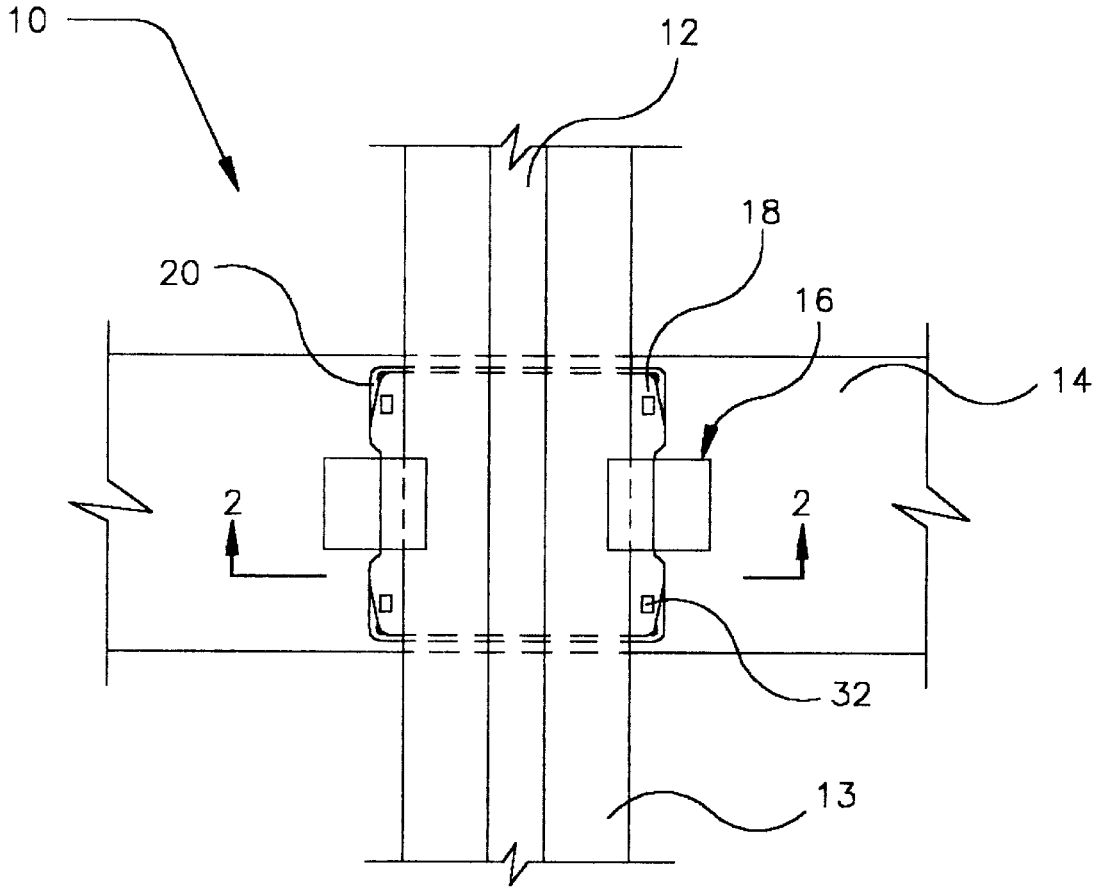
FIG. 1 is a plan view of the railroad tie mounting assembly of the present invention.

Referring to FIG. 1, a portion of a railroad track utilizing the inventive rail seat 10 is shown. As can be seen in FIG. 1, rail 12 is positioned over a concrete rail tie 14.

In a new installation concrete rail tie 14 is typically cast off-site and then transported to the needed location. Alternatively, rail tie 14 can be cast in place with equipment transported to the needed location. As a further alternative, rail tie 14, can be constructed from materials other than concrete and suitable materials for a railroad tie with which the inventive rail seat 10 is useful include wood and high strength plastics.

Rail 12, which can be any standard rail used in the industry, comprises a portion which acts as a support flange 15. Rail 12 is held in place by a clamping mechanism 16, which forces the bottom surface 17 of flange 15 against the top of a rail pad 18.

The inventive rail seat 10 is positioned between surface 17 on the bottom of rail 12 and the concrete rail tie 14. Rail seat 10 is made up of a rail pad 18 and a coated plate 20. as can be seen most clearly in FIG. 3, rail pad 18 is positioned over coated plate 20. Coated plate 20 comprises an alloy steel member 21 made of high strength steel, and is about 20 cm square.

In accordance with the preferred embodiment of the invention, plate 21 is made from a non-corrodible high strength low alloy steel, with a minnimum 50,000 psi yield strength. Its thickness can typically vary from 1–1.5 millimeters depending on the nature of the loads to which it will be subjected. In principle, there are no disadvantages associated with having a plate thickness greater than 1.5 mm. Thus, the thickness can be varied to retrofit an existing installation.

However, when the thickness drops below 1 millimeter the plate will be too thin and there is a possibility that it will break. Therefore, the steel plate 21 must be of sufficient strength to withstand the forces that are placed on it.

Coated plate 20 also incorporates a polyurethane coating 22 which is disposed over steel plate 21. Polyurethane coating 22 is applied to the steel plate 21 in the form of a spray. In accordance with the present invention, polyurethane coating 22 is relatively hard but will give once subjected to loads typically applied by a railroad car passing over the installed rail seat 10. More particularly, coating 22 is soft enough to be indented slightly in response to pressure from a fingernail.

Coating 22 is formed by being sprayed onto steel plate 21, using a special spraying device which has been charged with a polyurathane adhesive type material. Alternatively, any other suitable material may be used, the same being allowed to cure in the matter recommended by the manufacturer.

After spraying, the polyurethane coating is allowed to cure by being allowed to dry at a temperature in the range 25 to 40 degrees Centigrade. In accordance with the preferred embodiment, coating 22 of polyurethane is deposited with a thickness of 0.4 mm except in the central region 23 of the film, indicated by the rectangular indication in the center of coating 22 and FIG. 6. In this central region 23 of coating 22, coating 22 as a thickness of 0.2 millimeters.

Figure 2:
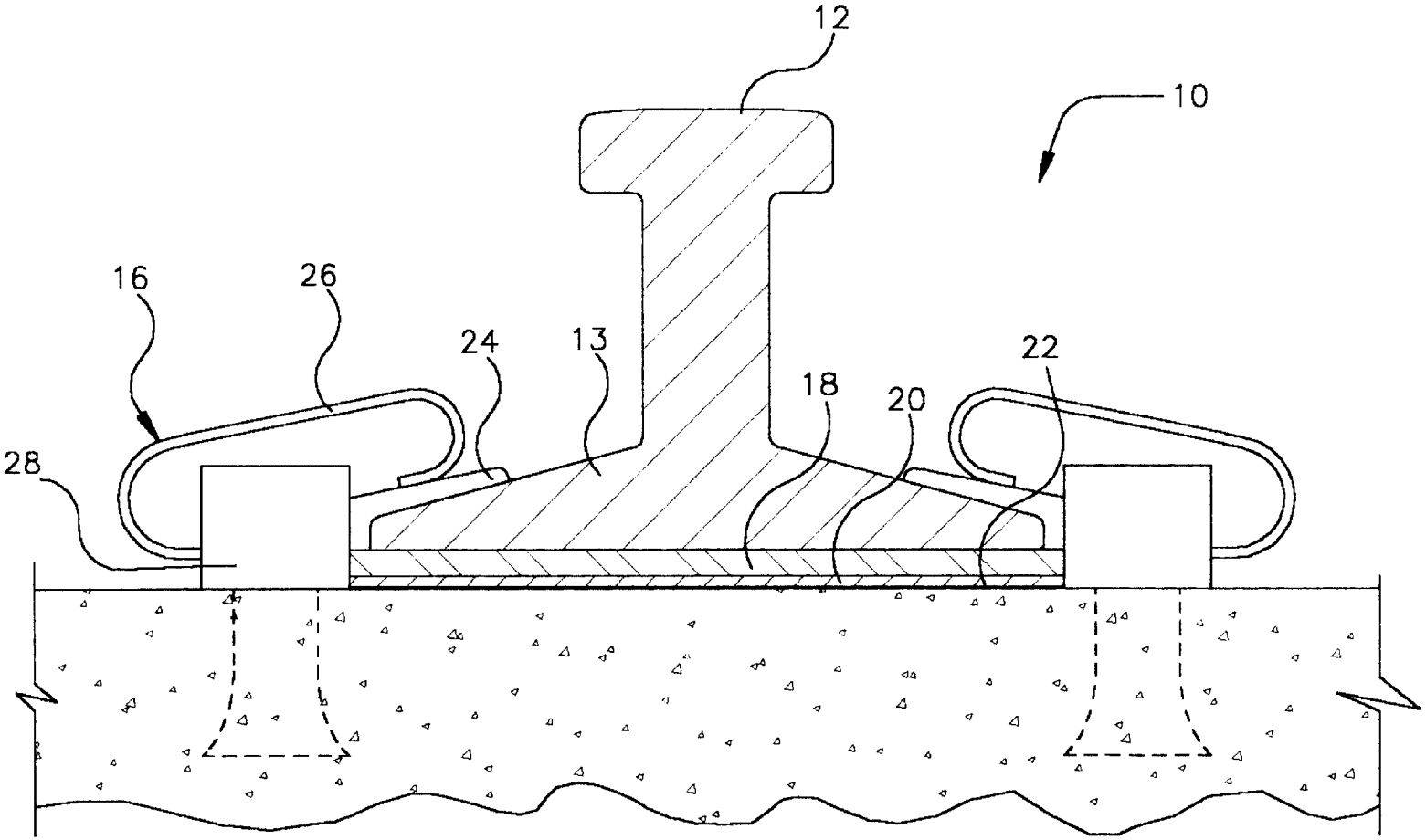
FIG. 2 is a cross sectional view of the present invention taken along lines 2—2 of FIG. 1.

Clamping mechanism 16 can be any standard railway clamp used in the industry. A typical rail clamping mechanism is shown in FIG. 2. In this embodiment of the invention, the clamping mechanism 16 comprises an insulator 24. Insulator 24 is positioned on top of flange 15 of rail 12. A spring shaped member 26 is anchored in a steel post 28 at one of its ends. The other end of shaped member 26 is mounted in steel post 28. Steel post 28 is embedded in the concrete rail tie 14, and securely held there by a stainless steel anchor portion 29. Because shaped member 26 rests on rail insulator 24, it never comes in contact with rail flange 15. Thus, rail 12 is completely electrically insulated from the ground.

Figure 3:
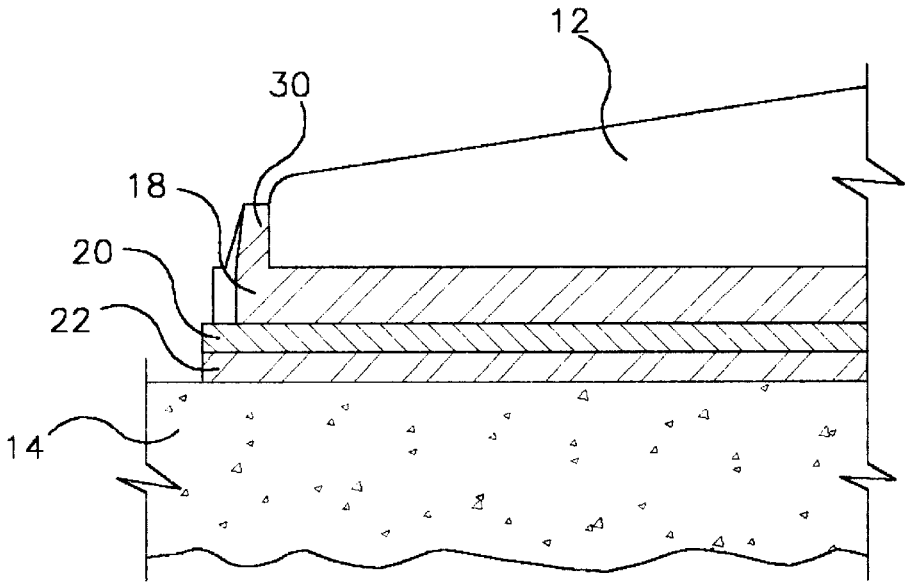
FIG. 3 is an enlarged cross sectional view of a portion of the present invention shown in FIG. 2.

As can be seen clearly in FIG. 3, rail pad 18 is positioned under rail 12. Below rail pad 18 is coated plate 20, which is positioned with its polymer coating 22 in contact with concrete rail tie 14.

Rail pad 18 is preferably constructed out of polyurethane plastic, however any material with suitable wear resistance and compressibility can also be used. In accordance with the preferred invention, rail pad 18 is injection molded using any of the typical plastic compositions used in the industry for the formation of polymer rail pads. The thickness of rail pad 18 can vary in the range of 5–7 mm, with 6 mm being preferred.

Figure 4:
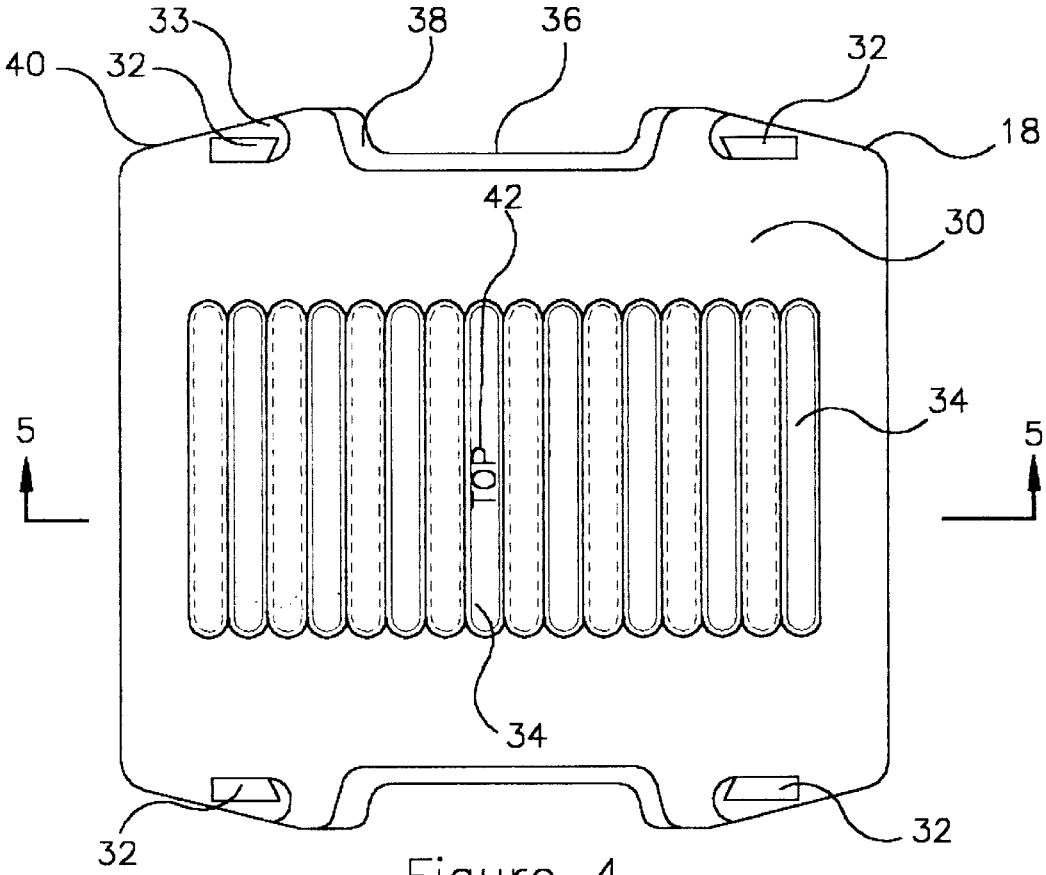
FIG. 4 is a top view of the elastometric rail pad used in the present invention.
Figure 5:
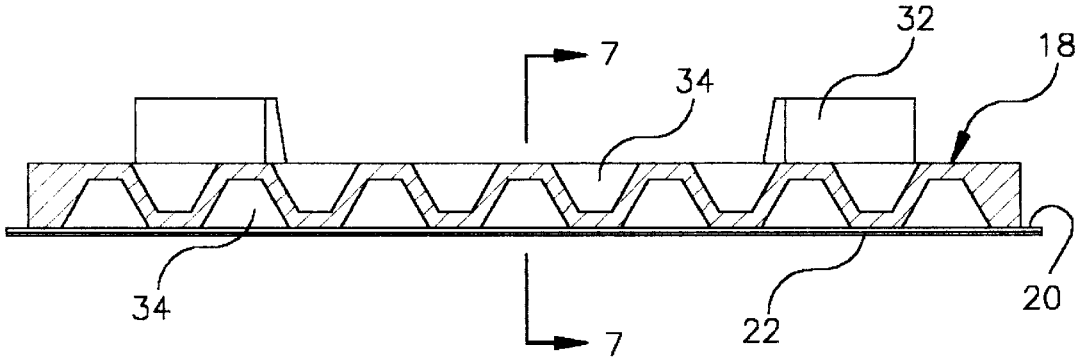
FIG. 5 is a cross sectional view of the elastometric rail pad showing the positioning of the air channels, taken along lines 5—5 of FIG. 4.

As illustrated in FIGS. 4 and 5, rail pad 18 consists of a generally planar portion 30, positioning tabs 32, and a plurality of air channels 34. Rail pad 18 has tapered corners 40. Rail pad 18 is also configured with cutout side portions 36 and shoulder recess 38 (FIG. 7) to allow enough room for mating engagement by clamping mechanism 16. Generally, rail pad 18 and metal plate 20 are of a similar width, length and shape. The width being such that flange 15 of rail 12 rests, nested between positioning tabs 32. Tabs 32 are formed at positions which provide for proper positioning of rail 12 on rail pad 18.

Positioning tabs 32 are located along the tapered portion of rail pad 18. Each of the tabs 32 has a base portion 33 which extends along tapered portion 40 of rail pad 18, and this base portion 33 is larger than the top portion of tabs 32.

Air channels 34 are present on the top and bottom portions of rail pad 18, and may run in the same direction or in the direction transverse to the rail. The air pockets created by air channels 34 enhance the sound and vibration dampening characteristics of the assembly. Air channels 34 are also configured with a directional identifier 44, defining the top of said rail pad 18. Directional identifier 44 takes the form of raised letters which spell out the word "top".

As shown in FIG. 5, air channels 34 alternate with one channel facing up and the other channel facing down along the length of rail pad 18. This feature also requires less material be used to manufacture the rail pad 18.

When a load passes over the inventive rail seat, the weight of the load imparts a vertical force that will tend to compress rail pad 18. This compression will cause a horizontal expansion of rail pad 18. Any horizontal movement of rail pad 18 will increase the wear and abrasion of the assembly. The narrower portions of the rail pad will because they are narrower expand less. Moreover, by positioning air channels 34 within rail pad 18, the inner walls 35 of rail pad 18 deflect towards one another thereby further minimizing the overall horizontal deflection of the rail pad and reducing undue wear and abrasion to the assembly.

When the assembly is located on a curve, the horizontal and vertical components of the force from the load, will cause the rail to rotate about its point of rotation, with the top of the rail moving in a direction towards the outside of the curve. By positioning air channels 34 longitudinally along the center portion of rail pad 18, the point of rotation is moved to a position outside of the rail, thereby reducing the tendency of rail 12 to rotate.

As shown in FIG. 4, rail pad 18 is configured with clamping recess 36 which facilitates the use of clamping mechanism 16. There is also an insulator receiving recess 38 which allows insulators 24 to be placed on top of rail flange 15, while still being held in place by shaped member 26.

Figure 6:
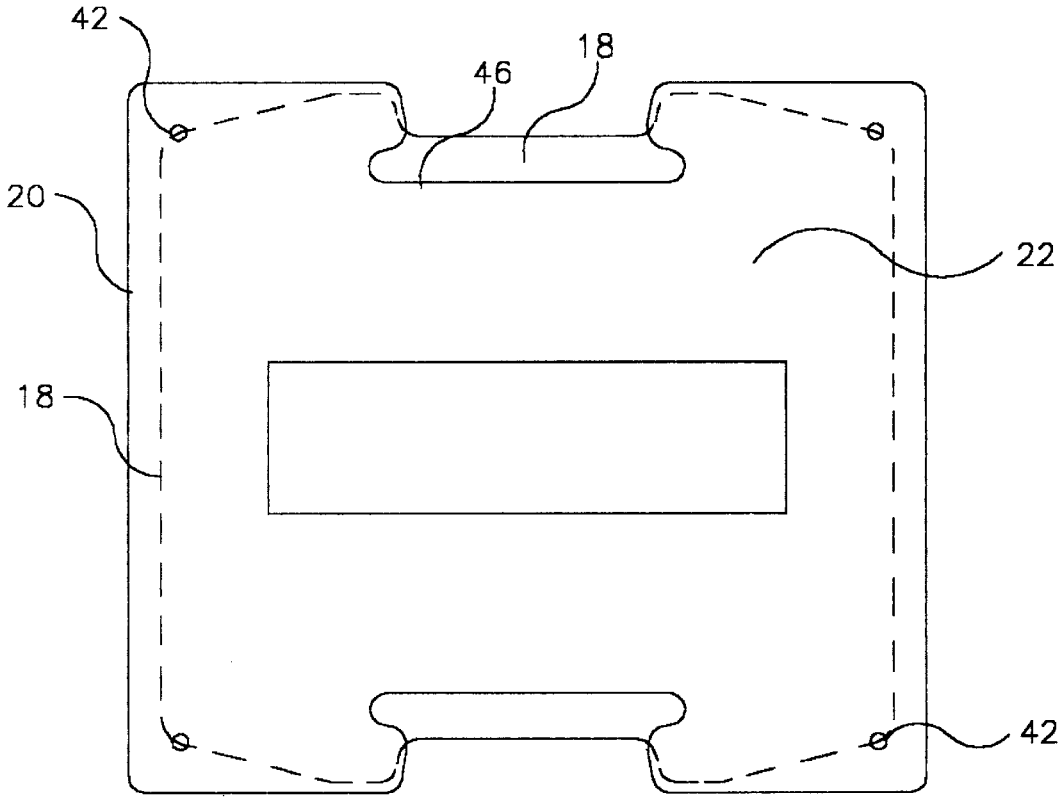
FIG. 6 is a bottom view of the rail seat showing the coated plate and the elastometric rail pad.

As shown in FIG. 6, coated plate 20 is configured with four holes 42 located around the periphery. There is also a recess 46 located on each side of coated plate 20 to allow enough room for clamping mechanism 16 to function. FIG. 6 also shows the positioning of rail pad 18 in relation to coated plate 20.

Coated plate 20 is coated with soft polyurethane coating 22. Coating 22 is applied to plate 20 prior to installation of the rail tie assembly. The polyurethane coating sufficiently adheres to the metal plate, so there is no possibility of movement of the plate in relationship to the coating. Soft polyurethane coating 22 may be sprayed on, or applied in any other manner. Coating 22 is preferably applied only onto one side of metal plate 20, however both sides of plate 20 may also be coated. The thinned out central region 23 of polyurethane coating 22 is achieved by placing a patch of tape over what will be the thinned out region 23, spraying polyurethane, removing the tape while the polyurethane is still relatively uncured, and then spraying a second coating of polyurethane over the plate.

The resulting in our region 23 as the desirable fact of providing a shallow void for the accommodation of any convexity in the top surface of the concrete railroad tie, thus eliminating the possibility of the plate rocking on top of the railroad tie.

Coating 22 is preferably made from a soft polyurethane. This is preferable because the soft polyurethane will conform to the uneven surface of the concrete tie, thereby keeping the metal plate in place. A harder substance such as high density polyethylene (HDPE), will not work because of its inherent characteristics. Due to the harder nature of HDPE, it will not conform sufficiently to the concrete tie, resulting in the movement of the metal plate relative to the concrete tie. Over time this will cause the deterioration of the concrete tie. While the conforming nature of a soft polyurethane, of the type used in coating 22, allows the metal plate to remain in place on the concrete tie. The thickness of coating 22 can vary from 0.5 millimeters up to 1 millimeter. Thicknesses over 1 millimeter will cause the assembly not to work sufficiently.

Figure 7:
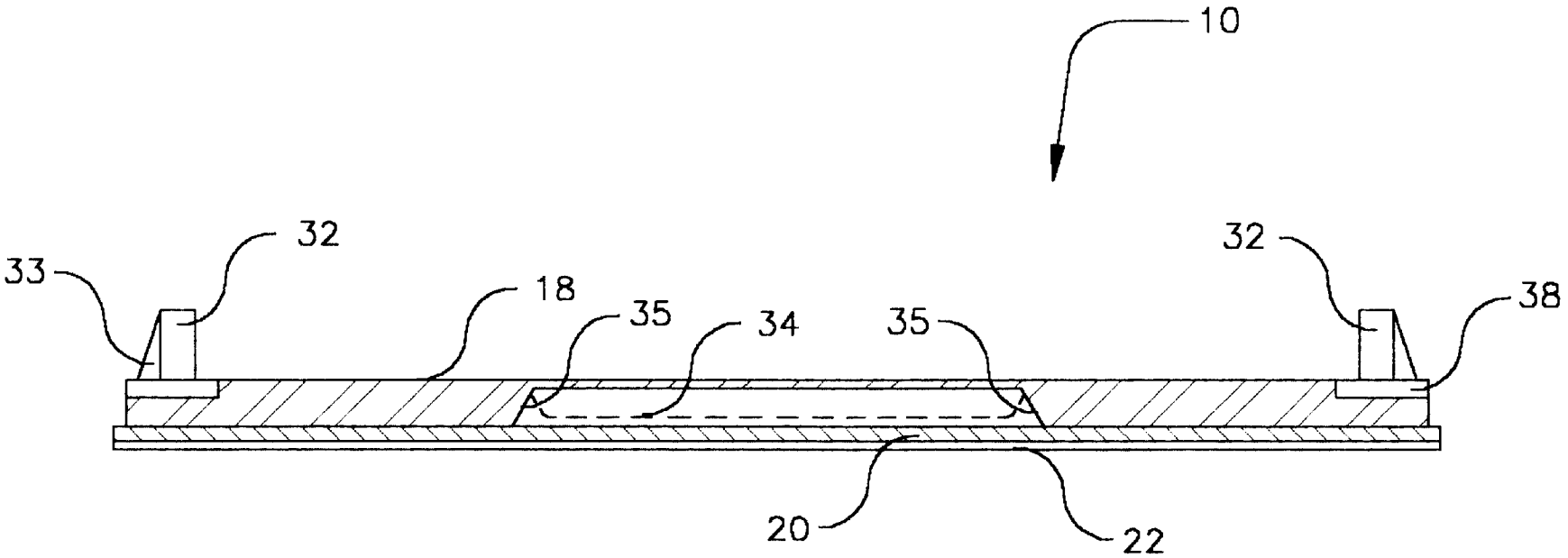
FIG. 7 is a cross sectional view of the inventive rail support assembly taken along lines 7—7 of FIG. 5.

FIG. 7 shows the inventive rail seat 10. The rail pad 18 is set on top of metal plate 20. Metal plate 20 has a coating 22 dispersed thereon. Rail pad 18 has positioning tabs 32 located such that a rail can be fitted between them. Positioning tabs 32 have a base 33 which is slightly larger than the top portion of tab 32. Recess 38 can also be seen clearly.

While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. A railroad rail seat assembly intended to be disposed on and supported by a rail support member and to support a railroad rail, said rail seat assembly comprising:

(a) a metal plate having a top surface and a bottom surface, said bottom surface being intended to rest on said rail support member;

(b) a polymer coating disposed on said bottom surface of said plate; and (c) an elastomeric rail pad having a top surface and a bottom surface, said elastomeric rail pad being positionable over said metal plate with the bottom surface of said elastomeric rail pad in contact with said metal plate, said rail being positioned over said top surface of said rail pad;

wherein said polymer coating has a central area of reduced thickness to accommodate irregularities on the top surface of said rail support member, leaving a thicker perimeter for supporting said plate on said rail support member.

2. A railroad seat assembly, as in claim 1, wherein said plate is made of corrosion-resistant steel.

3. An assembly as in claim 1, wherein said rail pad is made of an electrically insulating material.

4. An assembly as in claim 1, wherein said rail pad defines at least one air channel having a length, a width, and a depth, said length of said air channel being greater than said width.

5. An assembly as in claim 4, wherein said depth does not exceed the thickness of said rail pad.

6. An assembly as in claim 5, wherein a plurality of positioning tabs are positioned on and integral with the top surface of said rail pad, said positioning tabs being located around the periphery of said top surface of said rail pad and defining between said positioning tabs an area on the top surface of said rail pad configured and dimensioned to receive said rail.

7. An assembly as in claim 6, wherein said plate is made of steel, said rail pad defines a plurality of air channels extending across the direction of said rail when said rail pad is in position, said air channels extending for a length substantially less than the width of said rail pad, and underlying said rail, said polymer coating having a central area of reduced thickness, said central area of reduced thickness defining a void for the accommodation of irregularities on the top surface of said rail support member, and a thicker perimeter for supporting said plate on said rail support member.

8. A railroad seat assembly, as in claim 4, wherein each said air channel opening into one only of said rail pad top and bottom surfaces.

9. An assembly as in claim 1, wherein said plate has substantially the same width and length as said rail pad.

10. An assembly as in claim 1, wherein a plurality of positioning tabs are positioned on and integral with the top surface of said rail pad.

11. An assembly as in claim 10, wherein an area is defined on the top surface of said rail pad between said positioning tabs, said area being configured and dimensioned to receive said rail.

12. An assembly as in claim 11, wherein said positioning tabs are located around the periphery of said top surface of said rail pad.

13. An assembly as in claim 1, wherein said rail pad defines at least one air channel having a length, a width, and a depth, said length of said air channel being greater than said width, and said depth not exceeding the thickness of said rail pad.

14. An assembly as in claim 13, wherein a plurality of positioning tabs are positioned on and integral with the top surface of said rail pad, said positioning tabs being located around the periphery of said top surface of said rail pad and defining between said positioning tabs an area on the top surface of said rail pad configured and dimension to receive said rail.

15. An assembly as in claim 1, wherein a plurality of positioning tabs are positioned on and integral with the top surface of said rail pad, said positioning tabs being located around the periphery of said top surface of said rail pad and defining between said positioning tabs an area on the top surface of said rail pad configured and dimensioned to receive said rail.

16. A railroad rail assembly comprising:

(a) a railroad rail having a support flange;

(b) a rail support member adapted to engage the ground;

(c) a rail seat disposed on and supported by said rail support member, said rail seat being positioned over said rail support member at a position, where it supports said rail at a position which allows said rail to be engaged by and to support a railroad car wheel, said rail seat comprising:

(i) a plate having a top surface and a bottom surface, said bottom surface resting on said railroad support member;

(ii) a polymer coating disposed on the bottom surface of said plate, whereby said polymer coating is in contact with said railroad support member and lies between said railroad support member and said plate;

(iii) a vibration absorbing elastomeric rail pad having a top surface and a bottom surface, said elastomeric rail pad being positioned with its bottom surface in contact with and positioned over said plate, said rail flange being positioned over said top surface of said rail pad; and (d) a clamping member for securing said rail against said rail pad;

wherein said polymer coating has a central area of reduced thickness to accommodate irregularities on the top surface of said railroad support member, leaving a thicker perimeter for supporting said plate on said railroad support member.

17. A railroad rail assembly as in claim 16, wherein said polymer coating covers substantially the entire bottom surface of said plate.

18. An assembly as in claim 16, wherein said plate is constructed from a corrosion-resistant metal.

19. An assembly as in claim 16, wherein said rail pad is constructed from an electrically insulating material.

20. An assembly as in claim 16, wherein said rail pad defines at least one air channel each said air channel opening into one only of said rail pad top and bottom surfaces and having a length, a width, and a depth, said length of said air channel being greater than said width, and said depth not exceeding the thickness of said rail pad.

21. An assembly as in claim 16, wherein said plate has substantially the same width and length as said rail pad.

22. An assembly as in claim 16, wherein a plurality of positioning tabs are positioned on and integral with the top surface of said rail pad, said positioning tabs being located around the periphery of said top surface of said rail pad and defining between said positioning tabs and area on the top surface of said rail pad configured and dimension to receive said rail flange.

23. A railroad rail seat assembly intended to be disposed on and supported by a rail support member and to support a railroad rail, said rail seat assembly comprising:

(a) a corrosion-resistant steel plate having a top surface and a bottom surface, said bottom surface being intended to rest on said rail support member;

(b) a polymer coating disposed on said bottom surface of said plate; and (c) an elastomeric rail pad having a top surface and a bottom surface, said elastomeric rail pad being positionable over said metal plate with the bottom surface of said elastomeric rail pad in contact with said metal plate, said rail being positioned over said top surface of said rail pad;

wherein said rail pad has:

i) a plurality of air channels each having a length, a width, and a depth not exceeding the thickness of said rail pad, said length of said air channel being greater than said width;

ii) a plurality of positioning tabs positioned on and integral with the top surface of said rail pad, said positioning tabs being located around the periphery of said top surface of said rail pad and defining between said positioning tabs an area on the top surface of said rail pad configured and dimensioned to receive said rail;

wherein said air channels extend across the direction of said rail when said rail pad is in position, for a length substantially less than the width of said rail pad, and underlying said rail;

and wherein said polymer coating has a central area of reduced thickness to accommodate irregularities on the top surface of said rail support member, and has a thicker perimeter for supporting said plate on said rail support member.

24. A railroad rail assembly comprising:

(a) a railroad rail having a support flange;

(b) a rail support member adapted to engage the ground;

(c) a rail seat disposed on and supported by said rail support member, said rail seat being positioned over said rail support member at a position, where it supports said rail at a position which allows said rail to be engaged by and to support a railroad car wheel, said rail seat, comprising:

(i) a plate having a top surface and a bottom surface, said bottom surface resting on said railroad support member, said plate being constructed from a non-corrodible metal;

(ii) a polymer coating disposed on substantially the entire bottom surface of said plate, whereby said polymer coating is in contact with said railroad support member and lies between said railroad support member and said plate, said polymer coating having a central area of reduced thickness, said central area of reduced thickness defining a void for the accommodation of irregularities on the top surface of said railroad support member, and a thicker perimeter for supporting, said plate on said railroad support member;

(iii) a vibration absorbing elastomeric rail pad having a top surface and a bottom surface, said elastomeric rail pad being positioned with its bottom surface in contact with and positioned over said plate, said rail flange being positioned over said top surface of said rail pad, said rail pad being made of an electrically insulating material, said rail pad defining at least one air channel having a length, a width, and a depth, said length of said air channel being greater than said width, and said depth not exceeding the thickness of said rail pad;

(iv) a plurality of positioning tabs positioned on and integral with the top surface of said rail pad, said positioning tabs being located around the periphery of said top surface of said rail pad and defining between said positioning tabs and area on the top surface of said rail pad configured and dimension to receive said rail flange; and (d) a clamping member for securing said rail against said rail pad and for keeping said rail pad in position over said plate.

* * * * *